US010863787B2

(12) United States Patent
Chen et al.

(10) Patent No.: US 10,863,787 B2
(45) Date of Patent: Dec. 15, 2020

(54) COVER SYSTEM

(71) Applicants: Li Ray Chen, Taipei (TW); Shih-Chun Chen, Taipei (TW)

(72) Inventors: Li Ray Chen, Taipei (TW); Shih-Chun Chen, Taipei (TW)

( * ) Notice: Subject to any disclaimer, the term of this patent is extended or adjusted under 35 U.S.C. 154(b) by 113 days.

(21) Appl. No.: 15/432,940

(22) Filed: Feb. 15, 2017

(65) Prior Publication Data

US 2017/0156433 A1 Jun. 8, 2017

Related U.S. Application Data

(63) Continuation-in-part of application No. 14/862,166, filed on Sep. 23, 2015, now abandoned.

(51) Int. Cl.

| | |
|---|---|
| ***A42B 3/00*** | (2006.01) |
| ***A42B 3/22*** | (2006.01) |
| ***A41D 27/00*** | (2006.01) |
| ***A41D 13/11*** | (2006.01) |

(52) U.S. Cl.

CPC ..... *A42B 3/003* (2013.01); *A41D 13/1153* (2013.01); *A41D 27/00* (2013.01); *A42B 1/006* (2013.01); *A42B 1/046* (2013.01); *A42B 3/22* (2013.01)

(58) Field of Classification Search

CPC ..... A42B 3/003; A42B 1/006; A42B 1/046; A42B 3/22; A41D 13/1153; A41D 27/00; A41D 13/11

See application file for complete search history.

(56) References Cited

U.S. PATENT DOCUMENTS

| | | | | |
|---|---|---|---|---|
| 5,007,115 | A * | 4/1991 | Denbow | A41D 23/00 2/202 |
| 5,765,230 | A * | 6/1998 | Sivret | A42B 1/046 2/202 |
| 5,822,800 | A * | 10/1998 | Anderson | A42B 1/041 2/202 |
| 6,088,838 | A * | 7/2000 | Sontag | A42B 1/046 2/202 |
| 6,442,763 | B1 * | 9/2002 | Larson | A42B 1/046 2/171 |
| 9,521,873 | B1 | 12/2016 | Mignone | |
| 2005/0015850 | A1 * | 1/2005 | Waldman | A41D 27/18 2/205 |
| 2015/0245675 | A1 | 1/2015 | Chinquee | |
| 2015/0135419 | A1 | 5/2015 | Moore et al. | |

FOREIGN PATENT DOCUMENTS

| | | |
|---|---|---|
| CN | 3946595 | 12/2014 |
| TW | M 496497 | 3/2015 |

OTHER PUBLICATIONS https://www.youtube.com/watch?v=dwCtPuwPZIs Seirus Innovation, Magnemask Featurette, Magnemask, May 31, 2016.

* cited by examiner

*Primary Examiner* — Khaled Annis

(74) *Attorney, Agent, or Firm* — John D. Tran; Rhema Law Group

(57) ABSTRACT

A method and apparatus can include: providing a cover, the cover including face cover, neck cover, crown cover, side cover, and back cover; creating a cover opening in the cover above the face cover for exposure of facial features of a user from the cover; attaching a helmet cover at an attachment point near the back cover configured to expand around a helmet; and forming a helmet cover opening.

10 Claims, 10 Drawing Sheets

COVER SYSTEM

CROSS-REFERENCE TO RELATED APPLICATIONS

This is a Continuation-in-Part of U.S. patent application Ser. No. 14/862,166 filed Sep. 23, 2015, and claims priority benefit to all common subject matter. The content of this application is incorporated herein by reference in its entirety.

TECHNICAL FIELD

This disclosure relates to garments, more particularly to garments providing configurable head, face, and helmet cover.

BACKGROUND

The balaclava has grown in popularity due to its ability to provide adjustable exposure of the head and neck of a wearer. The balaclava can be maintained indifferent configurations ensuring a wearer is comfortable at different activity levels and in differing temperatures.

The balaclava is generally used in cold environments and can be adapted to use with cold weather activities such as skiing, snowboarding, motorcycling, and bicycling. When implementing the balaclava in cold environments an aversion to wearing both a helmet and a balaclava can arise leaving many sports enthusiasts either over exposed to weather, under protected in terms of safety, or forced to spend more money on a helmet specifically adapted to cold weather and coupling it with multiple other clothing items.

Solutions have been long sought but prior developments have not taught or suggested any complete solutions, and solutions to these problems have long eluded those skilled in the art. Thus there remains a considerable need for devices and methods that can provide versatility, usability, and customizability with helmets.

SUMMARY

A cover system and methods, providing versatility, usability, and customizability with helmets, are disclosed. The cover system and methods can include: providing a cover, the cover including face cover, neck cover, crown cover, side cover, and back cover; creating a cover opening in the cover above the face cover for exposure of facial features of a user from the cover; attaching a helmet cover at an attachment point near the back cover configured to expand around a helmet; and forming a helmet cover opening in the helmet cover configured to allow access to a back portion of the helmet.

Other contemplated embodiments can include objects, features, aspects, and advantages in addition to or in place of those mentioned above. These objects, features, aspects, and advantages of the embodiments will become more apparent from the following detailed description, along with the accompanying drawings.

BRIEF DESCRIPTION OF THE DRAWINGS

The cover system is illustrated in the figures of the accompanying drawings which are meant to be exemplary and not limiting, in which like reference numerals are intended to refer to like components, and in which.

DETAILED DESCRIPTION

Figure 1:
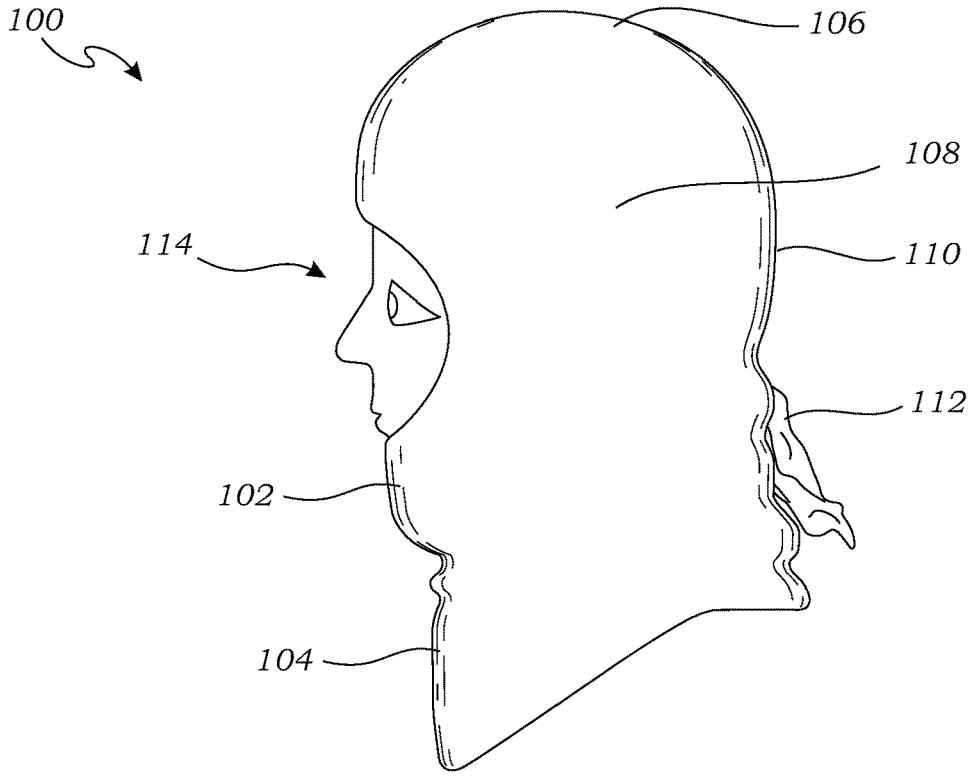
FIG. 1 is a side view of the cover system in a first embodiment and in a partially extended face cover and retracted helmet cover configuration.

In the following description, reference is made to the accompanying drawings that form a part hereof, and in which are shown by way of illustration, embodiments in which the cover system may be practiced. It is to be understood that other embodiments may be utilized and structural changes may be made without departing from the scope of the cover system.

When features, aspects, or embodiments of the cover system are described in terms of steps of a process, an operation, a control flow, or a flow chart, it is to be understood that the steps can be combined, performed in a different order, deleted, or include additional steps without departing from the cover system as described herein.

The cover system is described in sufficient detail to enable those skilled in the art to make and use the cover system and provide numerous specific details to give a thorough understanding of the cover system; however, it will be apparent that the cover system may be practiced without these specific details.

In order to avoid obscuring the cover system, some well-known system configurations are not disclosed in detail. Likewise, the drawings showing embodiments of the system are semi-diagrammatic and not to scale and, particularly, some of the dimensions are for the clarity of presentation and are shown greatly exaggerated in the drawing FIGs. Generally, the cover system can be operated in any orientation.

Referring now to FIG. 1, therein is shown a side view of the cover system 100 in a first embodiment and in a partially extended face cover 102 and retracted helmet cover 112 configuration. The cover system 100 can be illustrated having a face cover 102, a neck cover 104, a crown cover 106, a side cover 108, a back cover 110, and a helmet cover 112.

The cover system 100 can be seen on a user 114. Illustratively, the cover system 100 can be seen with the face cover 102 covering a chin portion of the user's 114 face below the user's 114 mouth leaving the user's 114 mouth, nose, and eyes exposed from the cover system 100.

The neck cover 104 can be seen extended to cover the user's 114 neck, including a rear area of the user's neck down to a top of the user's 114 shoulders. The neck cover 104 can extend up from the user's 114 shoulders to connect with the side cover 108 and the back cover 110 of the cover system 100.

The side cover 108 can extend from a temple of the user 114 to the back of the user's 114 head. The back cover 110 can extend around the back of the user's 114 head and connect to the side cover 108 on either side of the user 114.

The side cover 108 and the back cover 110 can extend upward to the crown cover 106. The crown cover 106 can cover the crown portion of the user's 114 head including the forehead and temple area.

The helmet cover 112 is shown extended down from and attached to the cover system 100 near the neck cover 104 and the back cover 110. The helmet cover 112 can be attached to the cover system 100 near the nape of the user's 114 head. The helmet cover 112 is shown to extend down from the attachment point to contact portions of the neck cover 104 between the neck and the helmet cover 112.

It has been discovered that the cover system 100 can improve safety when implemented in a highly visible color, with a highly visible pattern, or with reflective material. It has further been discovered that the cover system 100 improve helmet compliance among sports enthusiasts by making the helmet more fashionable and allowing the helmet to blend into the garments warn by the enthusiast.

It has further been discovered that attaching the helmet cover 112 to the cover system 100 secures the helmet to the user's 114 head through the cover system 100. It has still further been discovered that the cover system 100 increases comfort when wearing a helmet by lining the interior surface of a helmet and increases warmth by creating an air pocket between the crown cover 106 and the helmet cover 112. It is contemplated that the cover system 100 can be implemented in fields of activity such as skiing, snowboarding, motorcycling, and bicycling.

Figure 2:
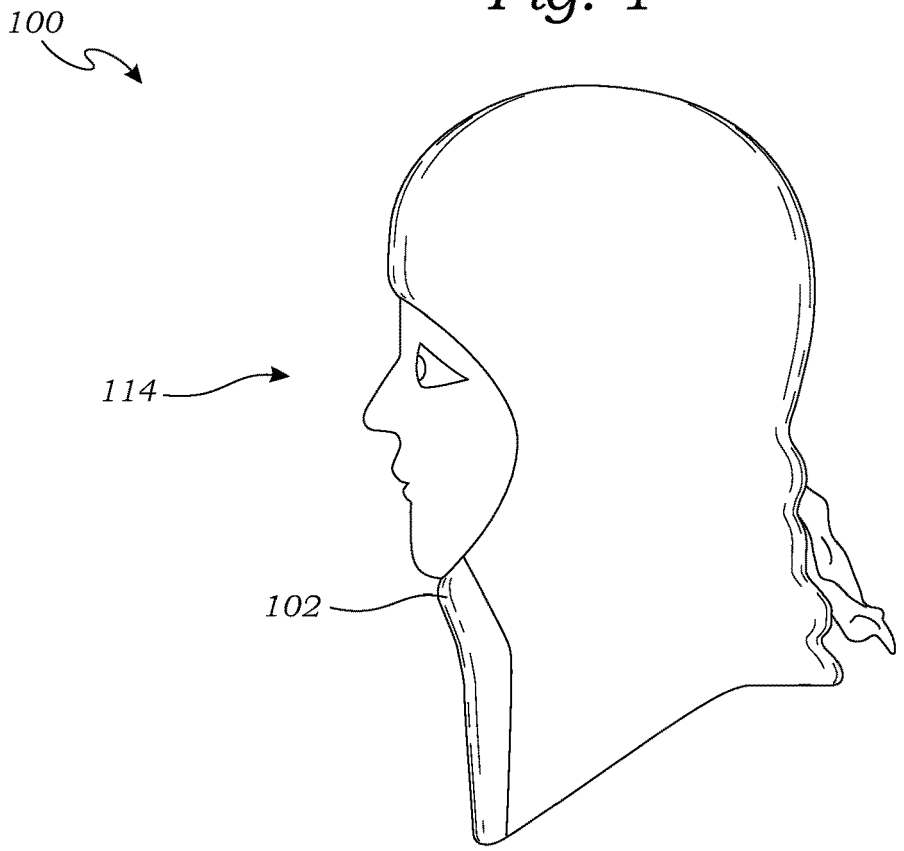
FIG. 2 is a side view of the cover system of FIG. 1 in a retracted face cover and retracted helmet cover configuration.

Referring now to FIG. 2, therein is shown a side view of the cover system 100 of FIG. 1 in a retracted face cover 102 and retracted helmet cover 112 configuration. The cover system 100 can be seen with the face cover 102 under a chin portion of the user's 114 face leaving the user's 114 chin, mouth, nose, and eyes exposed from the cover system 100.

Figure 3:
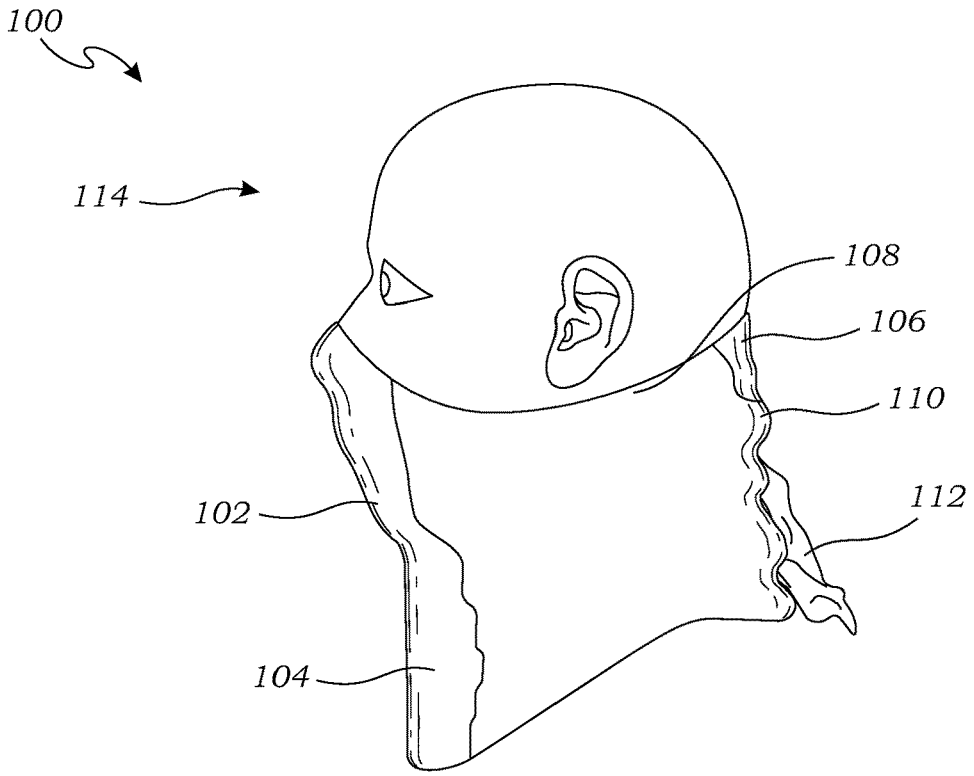
FIG. 3 is a side view of the cover system of FIG. 1 in an extended face cover, retracted crown cover, and retracted helmet cover configuration.

Referring now to FIG. 3, therein is shown a side view of the cover system 100 of FIG. 1 in an extended face cover 102, retracted crown cover 106, and retracted helmet cover 112 configuration. The cover system 100 is depicted having the face cover 102 extended up to cover the user's 114 chin, mouth, and nose. The side cover 108, the back cover 110, and the crown cover 106 are retracted to expose the user's 114 forehead, crown, sides, and back of the head below the user's 114 ears.

The crown cover 106 and the back cover 110 can be folded or scrunched up at the back or nape of the user's 114 head near the helmet cover 112. The side cover 108 can be folded or scrunched up near the cheek of the user 114.

Figure 4:
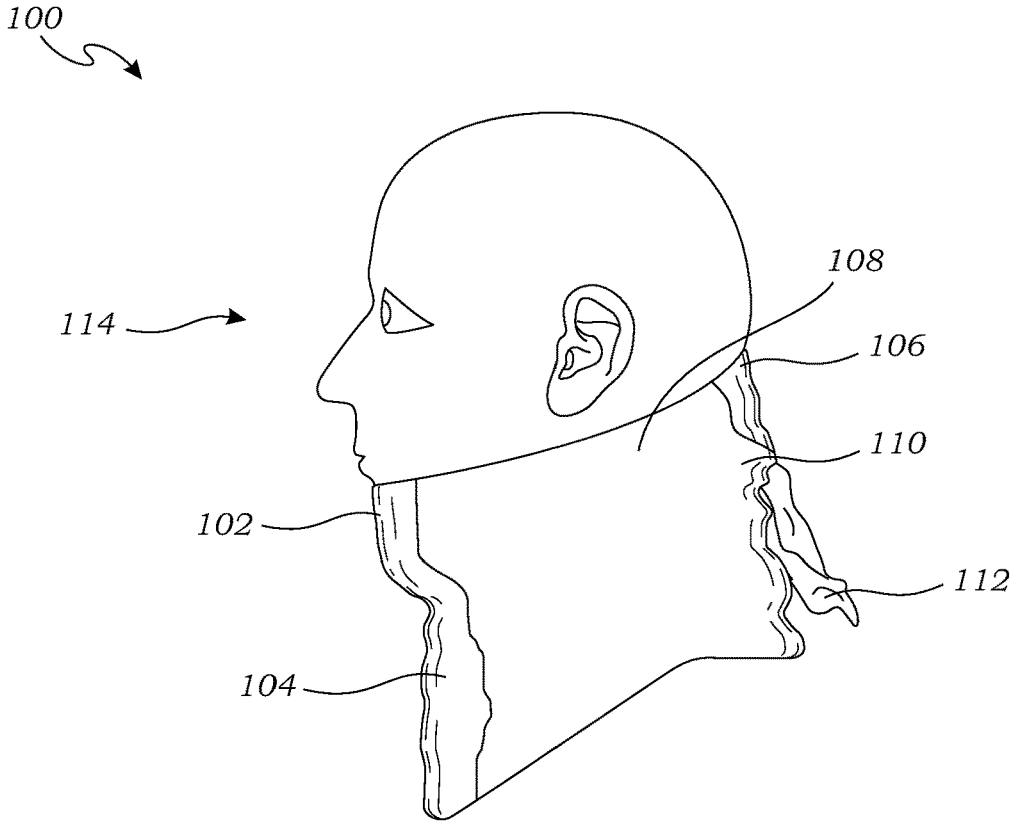
FIG. 4 is a side view of the cover system of FIG. 1 in a partially extended face cover, retracted crown cover, and retracted helmet cover configuration.

Referring now to FIG. 4, therein is shown a side view of the cover system 100 of FIG. 1 in a partially extended face cover 102, retracted crown cover 106, and retracted helmet cover 112 configuration. The cover system 100 is depicted having the face cover 102 extended up to and below the user's 114 mouth to cover the user's 114 chin leaving the user's 114 mouth and nose exposed from the cover system 100. The side cover 108, the back cover 110, and the crown cover 106 are retracted to expose the user's 114 forehead, crown, sides, and back of the head below the user's 114 ears.

The crown cover 106 and the back cover 110 can be folded or scrunched up at the back or nape of the user's 114 head near the helmet cover 112. The side cover 108 can be folded or scrunched up near the cheek of the user 114.

Figure 5:
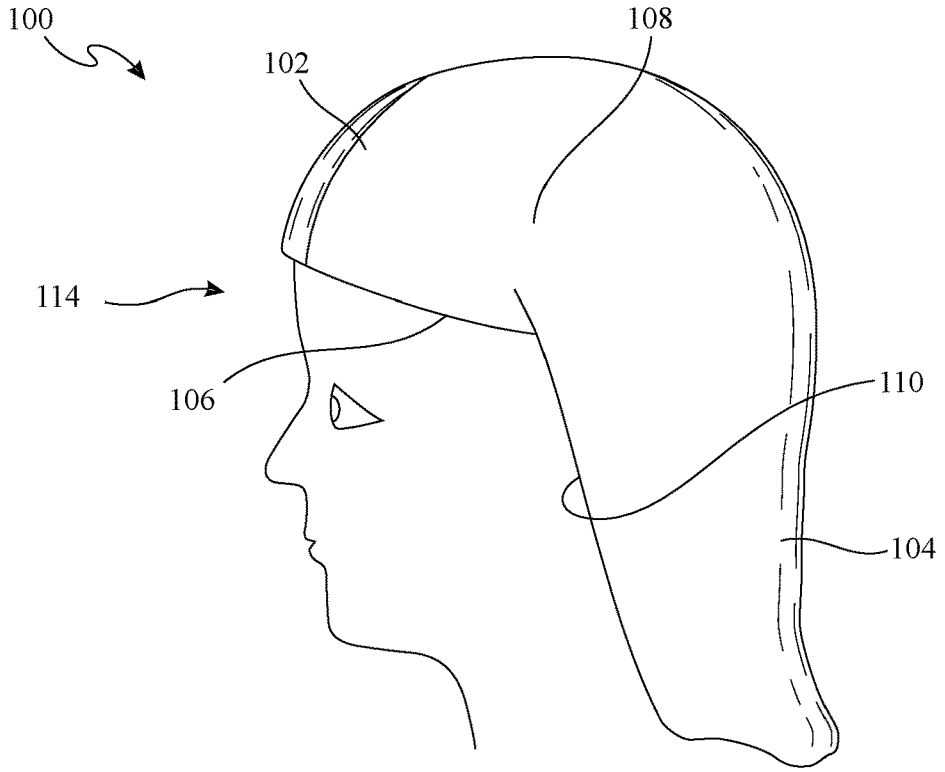
FIG. 5 is a side view of the cover system of FIG. 1 in a venting configuration.

Referring now to FIG. 5, therein is shown a side view of the cover system 100 of FIG. 1 in a venting configuration. The neck cover 104 is depicted extended up over the crown of the user's 114 head and laid down the back of the user's 114 head toward the user's 114 neck.

The face cover 102, the side cover 108 and the back cover 110 are folded up toward the crown of the user's 114 head so as to expose the face as well as the sides and back of the user's 114 head from the cover system 100. The crown cover 106 of the cover system 100 is shown contacting the crown of the user's 114 head.

Figure 6:
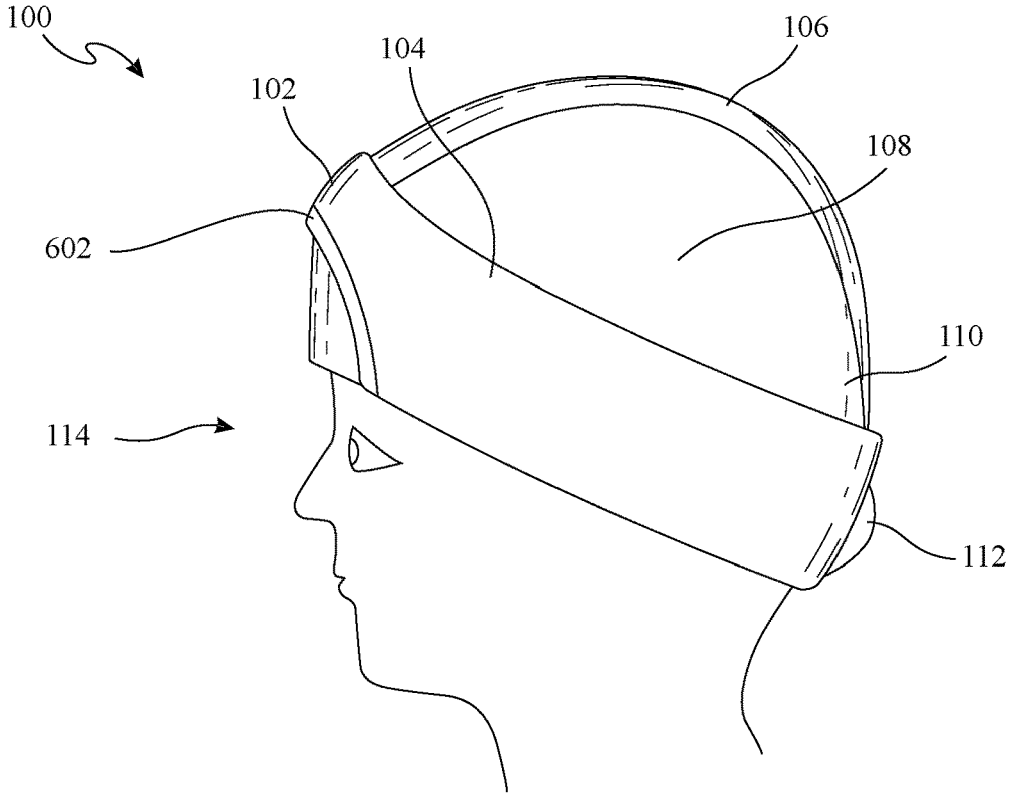
FIG. 6 is a side view of the cover system in a beanie configuration.

Referring now to FIG. 6, therein is shown a side view of the cover system 100 in a beanie configuration. The neck cover 104 and the face cover 102 are depicted rolled or folded up onto the sides and back of the user's 114 head.

The user's 114 face, as well as portions of the sides and back of the user's 114 head are exposed from the cover system 100. The crown cover 106 of the cover system 100 is shown contacting the crown of the user's 114 head.

Portions of the side cover 108 and the back cover 110 are also shown in direct contact with the user's 114 head. The helmet cover 112 is shown as a bulge near the back of the user's 114 head extending out from the rolled or folded neck cover 104. Linings 602 are depicted around the cover opening.

Figure 7:
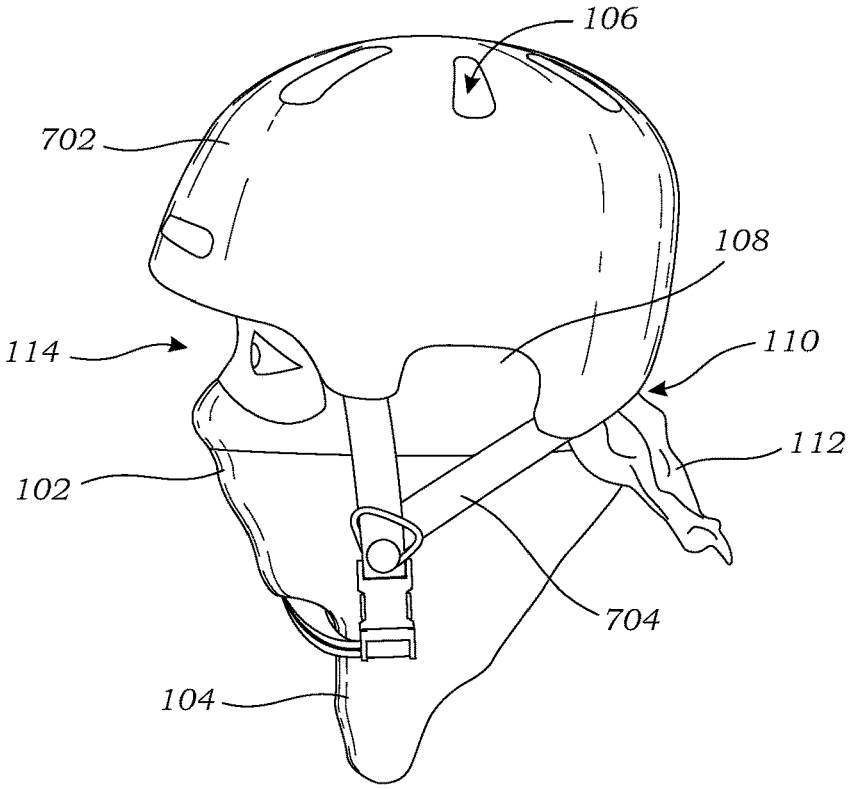
FIG. 7 is a side view of the cover system of FIG. 1 with a helmet in an extended face cover and retracted helmet cover configuration.

Referring now to FIG. 7, therein is shown a side view of the cover system 100 of FIG. 1 with a helmet 702 in an extended face cover 102 and retracted helmet cover 112 configuration. The cover system 100 can be seen with the face cover 102 extended up over a nose of the user 114 covering the nose, the chin and the mouth of the user 114. The eyes of the user 114 are exposed from the cover system 100.

The cover system 100 is depicted including the helmet 702 covering the crown cover 106, portions of the side cover 108, and the back cover 110. The face cover 102 and the neck cover 104 can extend from underneath the helmet 702. The helmet cover 112 is further depicted extended out below the helmet 702 and attached to the cover system 100 near the neck cover 104 and the back cover 110. The neck cover 104 is depicted as configured to extend between a neck of the user and the helmet cover 112.

The helmet 702 is depicted as including straps 704 extended from sides of the helmet 702 to below the user's 114 chin. The straps 704 can be external to the face cover 102, and the neck cover 104.

Figure 8:
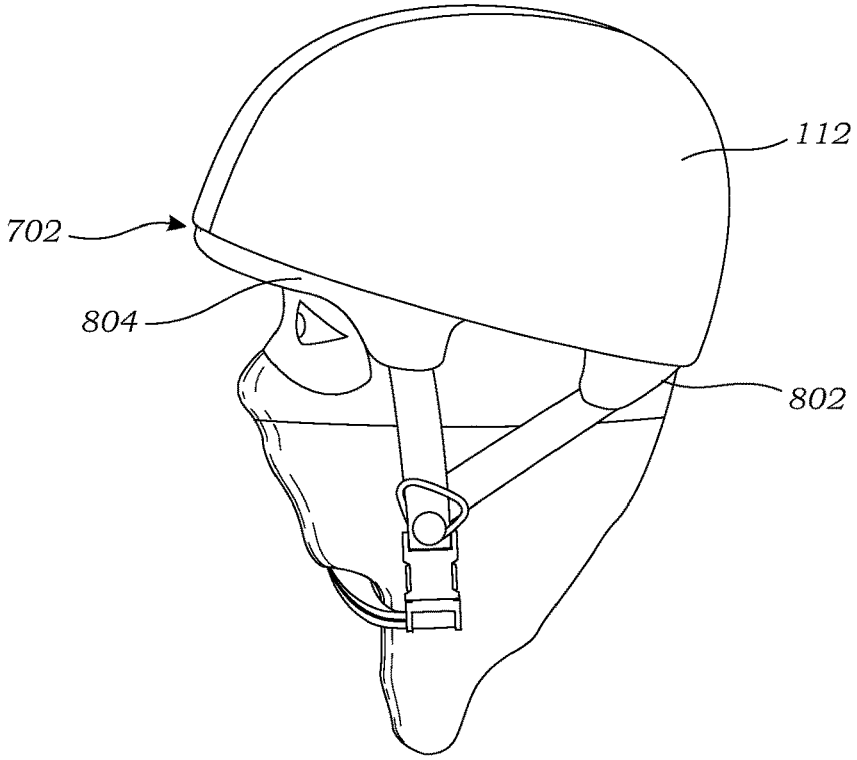
FIG. 8 is a side view of the cover system of FIG. 7 in an extended helmet cover configuration.

Referring now to FIG. 8, therein is shown a side view of the cover system 100 of FIG. 7 in an extended helmet cover 112 configuration. The helmet cover 112 is depicted covering portions of the helmet 702.

The helmet cover 112 can extend up from an attachment point 802 near the back cover 110 of the cover system 100 around a top and sides of the helmet 702. The helmet 702 is not shown fully covered near a bottom edge allowing a lower rim 804 of the helmet 702 to be exposed from the helmet cover 112.

Figure 9:
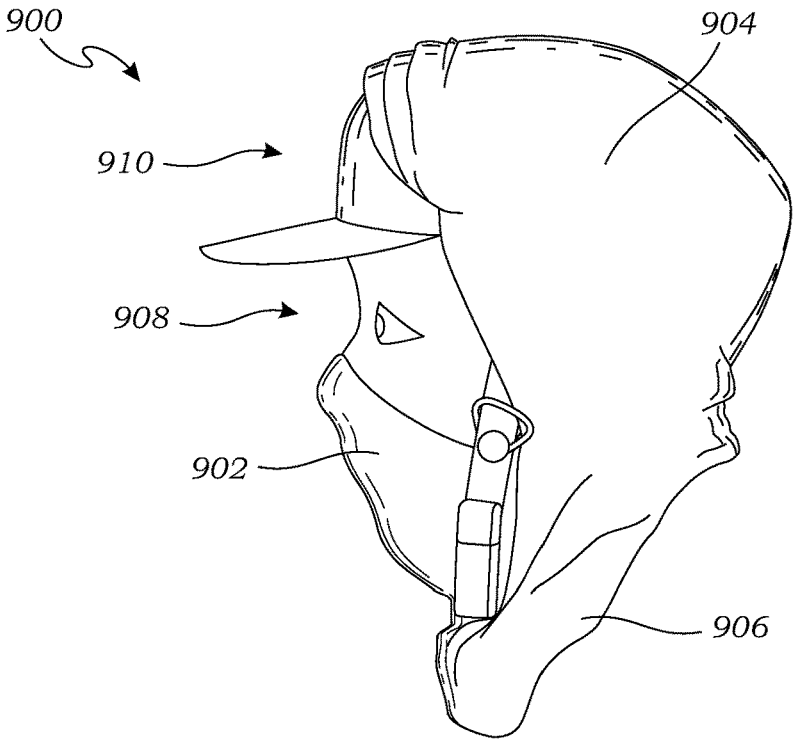
FIG. 9 is a side view of the cover system in a second embodiment and in an extended face cover and extended helmet cover configuration.

Referring now to FIG. 9, therein is shown a side view of the cover system 900 in a second embodiment and in an extended face cover 902 and extended helmet cover 904 configuration. The face cover 902 is depicted extending from a neck cover 906 up over a chin, mouth, and nose of a user 908. The helmet cover 904 can extend from and be integrally formed with the face cover 902 and the neck cover 906.

The helmet cover 904 can cover a helmet (not shown). The helmet cover 904 can include extensions 910. The extensions 910 are depicted as a baseball hat having a baseball hat bill extending out away from the forehead of the user 908.

The extensions 910 can increase the usability of the cover system 900 by shading the eyes of the user 908 or protecting the user's 908 face from the elements. Helmet straps 912 are shown extending from below the helmet cover 904 out covering portions of the face cover 902 and extending below a chin of the user 908.

Figure 10:
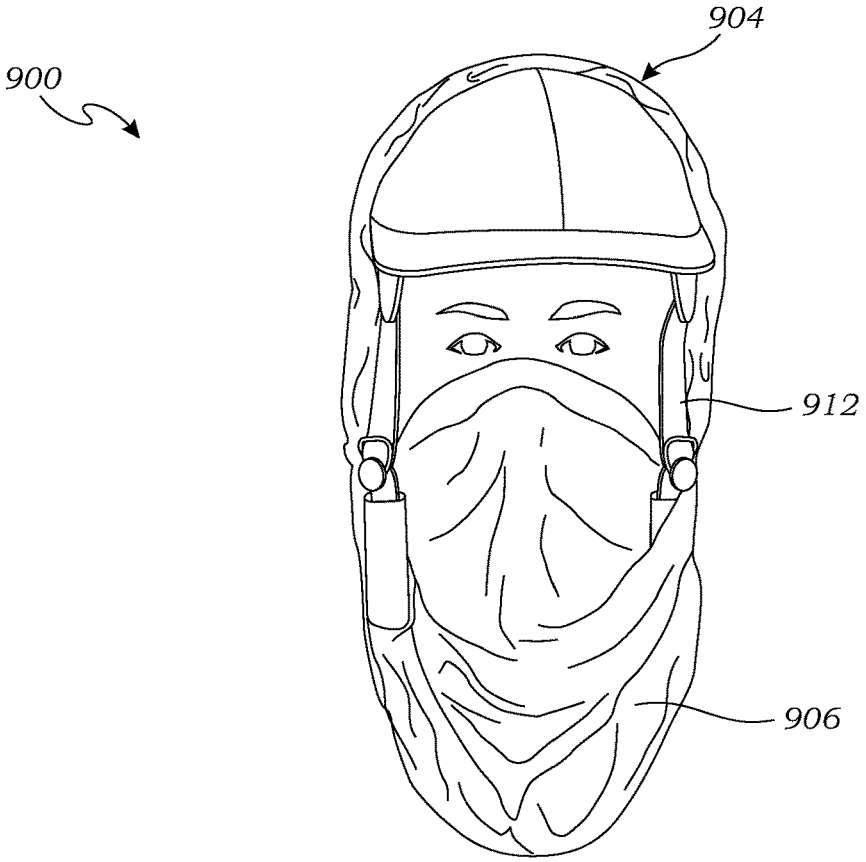
FIG. 10 is a front view of the cover system of FIG. 9.

Referring now to FIG. 10, therein is shown a front view of the cover system 900 of FIG. 9. The cover system 900 is depicted having the helmet straps 912 extended from below the helmet cover 904. One of the helmet straps 912 is depicted as folded into the neck cover 906 of the cover system 900. The cover system 900 can further include the crown cover 106, side cover 108, and back cover 110 of FIG. 1 although it is covered in the present embodiment by a helmet and the helmet cover 904.

Figure 11:
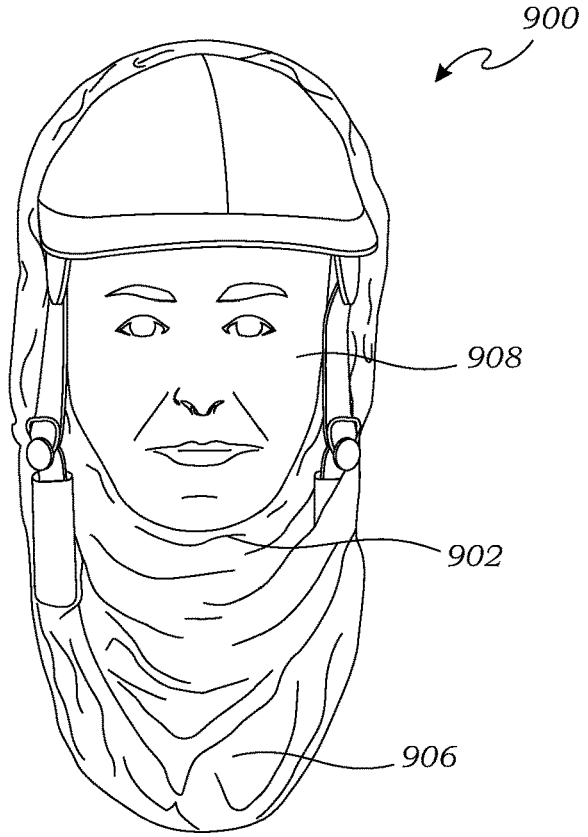
FIG. 11 is a front view of the cover system of FIG. 9 in a retracted face cover configuration.

Referring now to FIG. 11, therein is shown a front view of the cover system 900 of FIG. 9 in a retracted face cover 902 configuration. The face cover 902 is depicted as folded or scrunched beneath the user's 908 chin exposing the user's 908 chin, mouth and nose from the cover system 900. The neck cover 906 is shown covering the user's 908 neck while the helmet cover 904 is shown covering the helmet (not shown).

Figure 12:
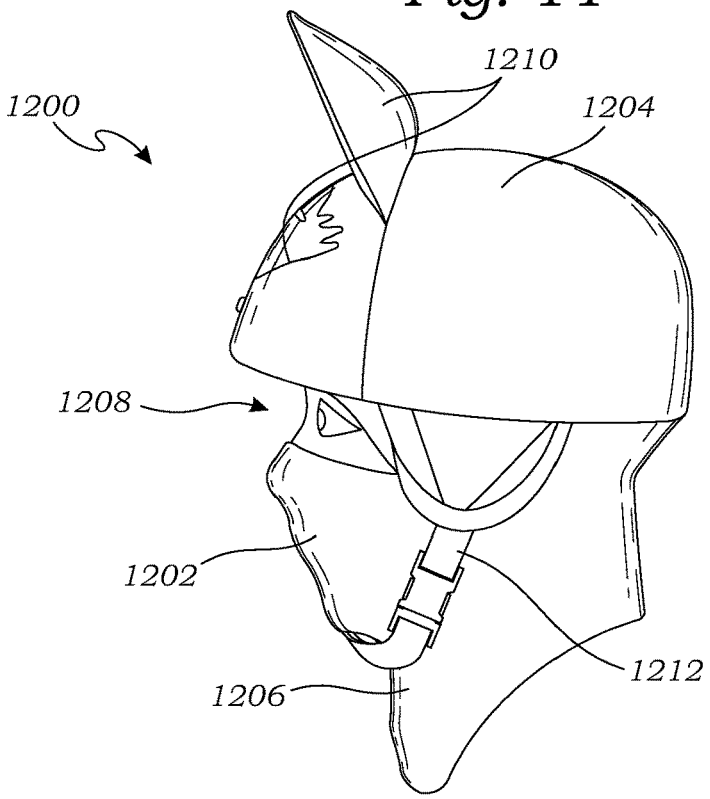
FIG. 12 is a side view of the cover system in a third embodiment and in an extended face cover and extended helmet cover configuration.

Referring now to FIG. 12, therein is shown a side view of the cover system 1200 in a third embodiment and in an extended face cover 1202 and extended helmet cover 1204 configuration. The face cover 1202 is depicted extending from a neck cover 1206 up over a chin, mouth, and nose of a user 1208. The helmet cover 1204 can extend from and be integrally formed with the face cover 1202 and the neck cover 1206.

The helmet cover 1204 can cover a helmet (not shown). The helmet cover 1204 can include extensions 1210 extending out of a surface of the helmet cover 904.

The extensions 1210 are depicted as a stuffed or plush animal having ears extending from the helmet cover 1204 and eyes, nose, and animal facial features extending from the front of the helmet cover 1204 near the forehead of the user 1208. The extensions 1210 can extend outward from the helmet cover 1204 over the front half of the helmet cover 1204. Helmet straps 1212 are shown extending out from below the helmet cover 1204, extending over portions of the face cover 1202, and extending below a chin of the user 1208.

Figure 13:
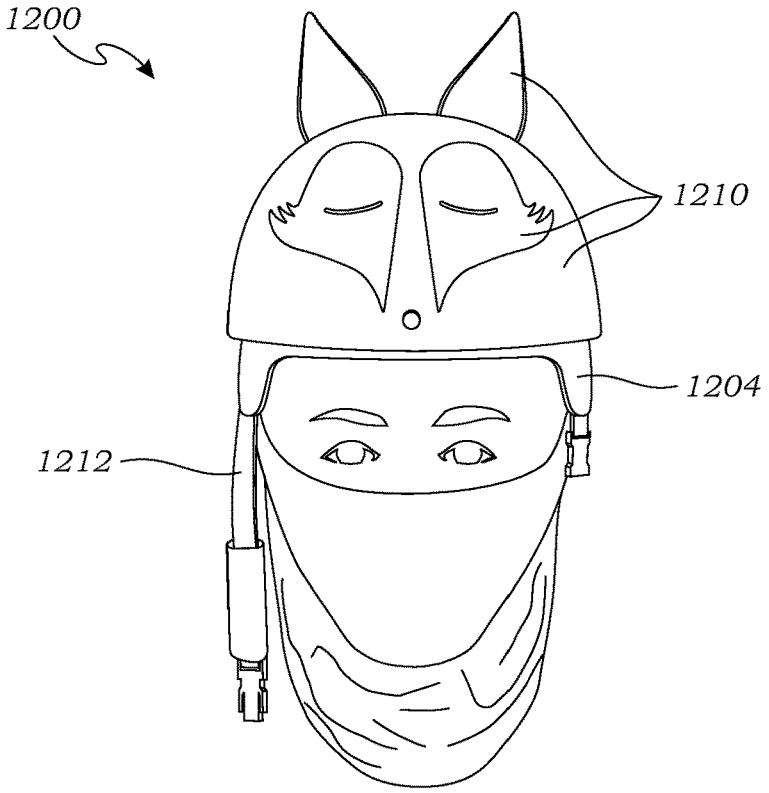
FIG. 13 is a front view of the cover system of FIG. 12.

Referring now to FIG. 13, therein is shown a front view of the cover system 1200 of FIG. 12. The helmet straps 1212 are depicted as loose and unbuckled.

The extensions 1210 can extend from the surface of the helmet cover 1204 and can increase the visibility of the cover system 1200 providing enhanced safety and visibility as well as providing an attractive design to entice children to wear a helmet when engaging in winter sports.

Figure 14:
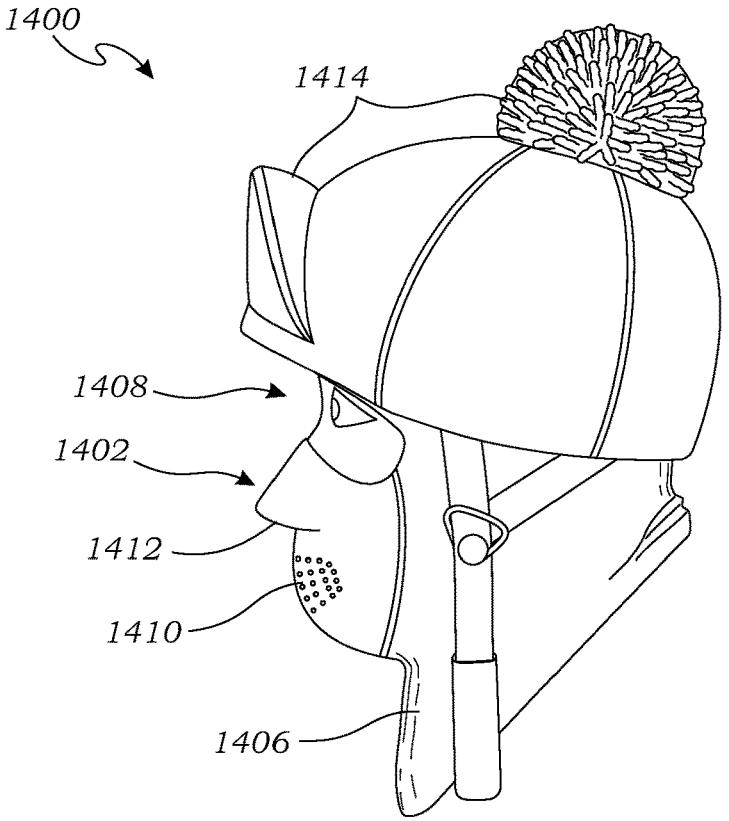
FIG. 14 is a side view of the cover system in a fourth embodiment and in an extended face cover and extended helmet cover configuration.

Referring now to FIG. 14, therein is shown a side view of the cover system 1400 in a fourth embodiment and in an extended face cover and extended helmet cover configuration. The face cover 1402 is depicted extending from a neck cover 1406 up over a chin, mouth, and nose of a user 1408.

The face cover 902 is depicted with vent holes 1410 and a nose slit 1412. The vent holes 1410 can provide venting for the user's 908 mouth while the nose slit 1412 can provide venting for the user's 908 nose.

The helmet cover 1404 can extend from and be integrally formed with the face cover 1402 and the neck cover 1406. The helmet cover 1404 can cover a helmet (not shown). The helmet cover 1404 can include extensions 1414 extending out of a surface of the helmet cover 904.

The extensions 1414 are depicted as a visor-like protrusion and a ball extending from the helmet cover 1404. Helmet straps 1412 are shown extending out from below the helmet cover 1404, extending over portions of the face cover 1402, and extending below a chin of the user 1408. It is contemplated that the cover system 1400 can be a bright or florescent color for the safety and visibility of the user 1408.

Figure 15:
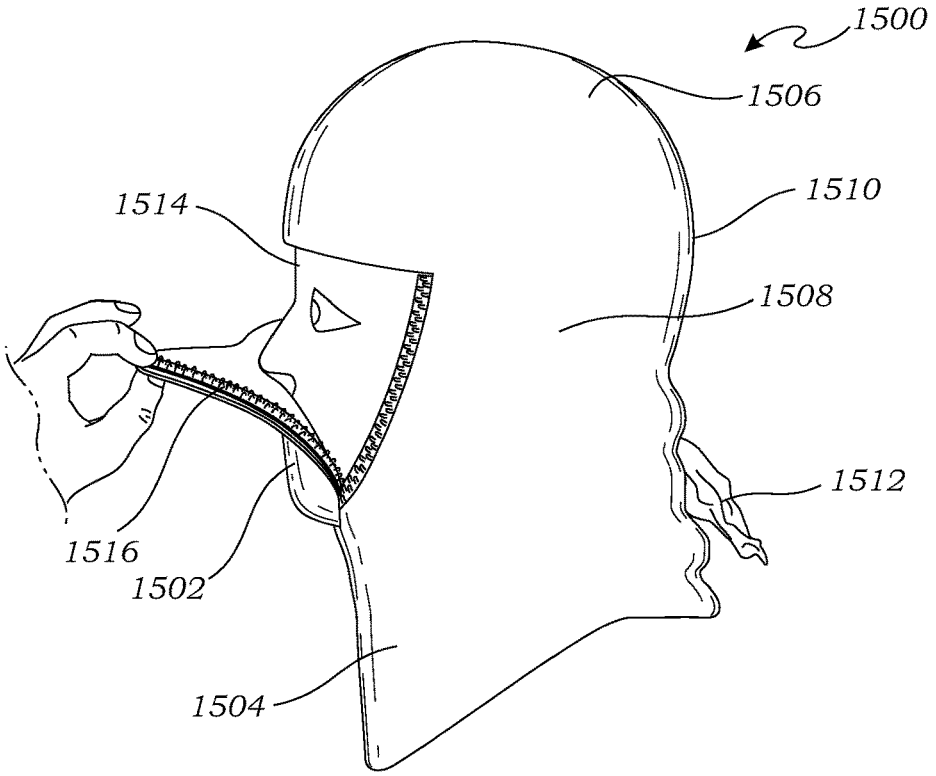
FIG. 15 is a side view of the cover system in a fourth embodiment and in an extended and partially unattached face cover, and retracted helmet cover configuration.

Referring now to FIG. 15, therein is shown a side view of the cover system 1500 in a fifth embodiment and in an extended and partially unattached face cover 1502, and retracted helmet cover 1512 configuration. The cover system 1500 can be illustrated having a face cover 1502, a neck cover 1504, a crown cover 1506, a side cover 1508, a back cover 1510, and a helmet cover 1512.

The cover system 1500 can be seen on a user 1514. Illustratively, the cover system 1500 can be seen with the face cover 1502 covering portions of the user's 1514 face.

The neck cover 1504 can be seen extended to cover the user's 1514 neck down to a top of the user's 1514 shoulders. The neck cover 1504 can extend up from the user's 1514 shoulders to connect with the side cover 1508 and the back cover 1510 of the cover system 1500.

The side cover 1508 can extend from a temple of the user 1514 to the back of the user's 1514 head. The back cover 1510 can extend around the back of the user's 1514 head and connect to the side cover 1508 on either side of the user 1514.

The side cover 1508 and the back cover 1510 can extend upward to the crown cover 1506. The crown cover 1506 can cover the crown portion of the user's 1514 head including the forehead and temple area.

The helmet cover 1512 is shown extended down from and attached to the cover system 1500 near the neck cover 1504 and the back cover 1510. The helmet cover 1512 can be attached near the nape of the user's 1514 head.

The face cover 1502 is in a partially unattached position on one side of the user 1514. The user 1514 is depicted holding a corner of the face cover 1502 away from the user's

1514 face. The face cover 1502 can include fasteners 1516 to releasably affix the face cover 1502 to the side cover 1508 of the cover system 1500.

The fasteners 1516 can be magnets or velcro. The fasteners 1516 can be positioned at the edges of the face cover 1502 and the side cover 1508 to ensure the face cover 1502 is releasably affixable to the side cover 1508. The fasteners 1516 can further be positioned near a bottom edge of the face cover 1502 and the edge of the neck cover 1504 to ensure the face cover 1502 is releasably affixed to the neck cover 1504.

Other contemplated embodiments can include the face cover 1502 permanently affixed to the neck cover 1504 or integrally formed therewith and having only the sides of the face cover 1502 releasably affixed to the rest of the cover system 1500.

Figure 16:
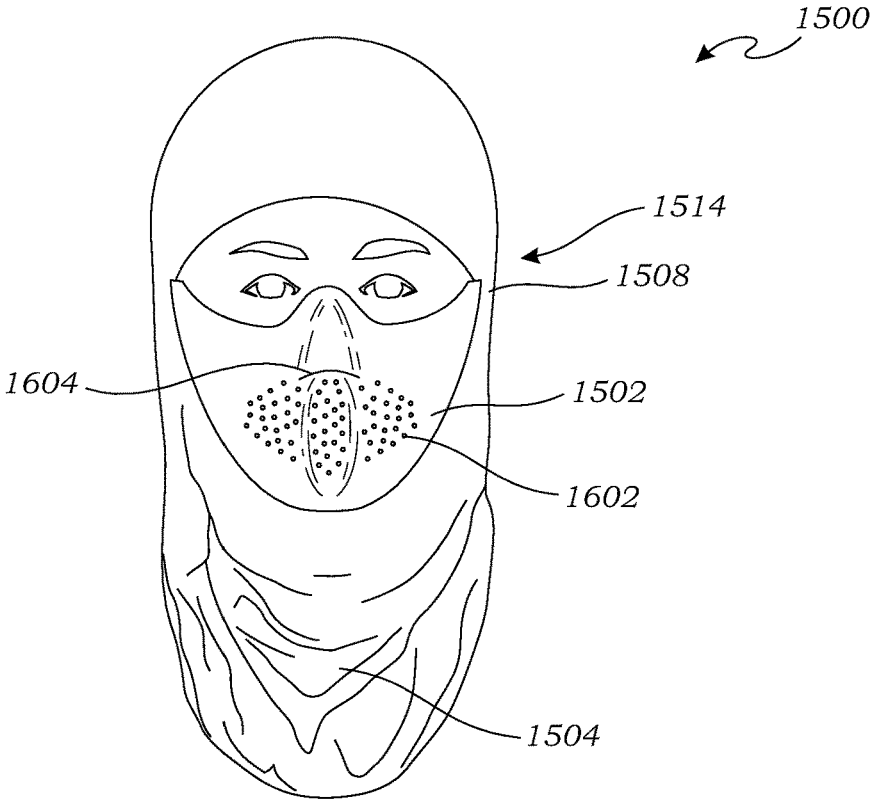
FIG. 16 is a front view of the cover system of FIG. 15 in an attached face cover configuration.

Referring now to FIG. 16, therein is shown a front view of the cover system 1500 of FIG. 15 in an attached face cover 1502 configuration. The face cover 1502 is shown fully covering the user's 1514 nose, mouth, and chin. The face cover 1502 is further shown with the fasteners 1516 on the face cover 1502 affixed to the fasteners 1516 on the neck cover 1504 and the side cover 1508.

The face cover 1502 is shown including vent holes 1602 and a nose slit 1604. The vent holes can provide ventilation for the user's 1514 mouth while the nose slit 1604 can provide ventilation for the user's 1514 nose.

Figure 17:
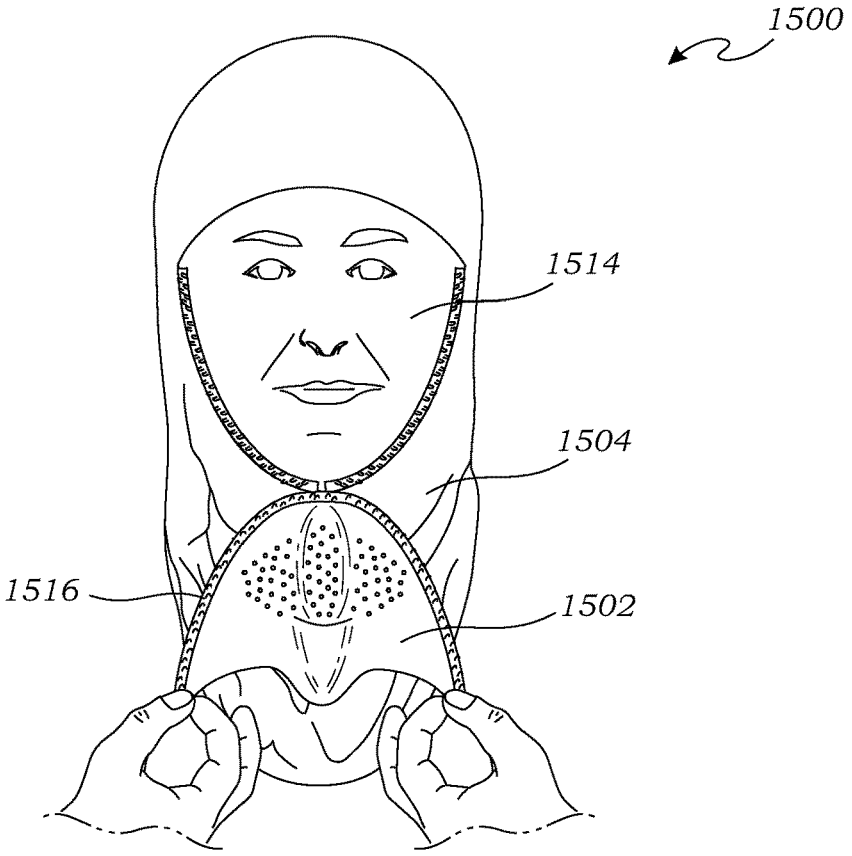
FIG. 17 is a front view of the cover system of FIG. 15 in an unattached face cover configuration.

Referring now to FIG. 17, therein is shown a front view of the cover system 1500 of FIG. 15 in an unattached face cover 1502 configuration. The face cover 1502 is depicted permanently affixed to the neck cover 1504 near a bottom portion of the face cover 1502.

The fasteners 1516 are depicted around the sides of the face cover 1502 extending from the attachment point at the neck cover 1504 up to the top of the face cover 1502. The face cover 1502 can be left hanging down to expose the user's 1514 face or can be attached to cover the user's 1514 nose, mouth, and chin.

Figure 18:
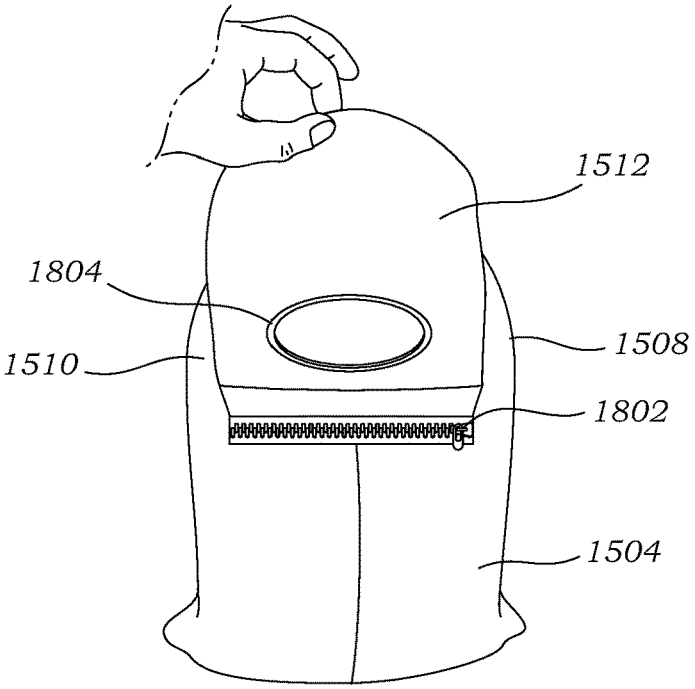
FIG. 18 is a back view of the cover system of FIG. 15.

Referring now to FIG. 18, therein is shown a back view of the cover system 1500 of FIG. 15. The helmet cover 1512 is shown attached to the side cover 1508, the back cover 1510, and the neck cover 1504 with a removable attachment 1802. The removable attachment 1802 is shown as a zipper that can maintain the helmet cover 1512 in a fixed position with regard to the side cover 1508 and the back cover 1510.

It is contemplated that the removable attachment 1802 can provide a customizability to the cover system 1500 by enabling various different helmet covers 1512 to be interchangeable and customizable. It has been discovered that the interchangeability of the helmet cover 1512 with the cover system 1500 can enable multiple different helmet styles, designs, and sizes to be used thus improving versatility and effectiveness while simultaneously reducing costs. The helmet cover 1512 is further depicted as including an opening 1804. The opening 1804 can be a stretchable opening which can stretch around a helmet (not shown).

Figure 19:
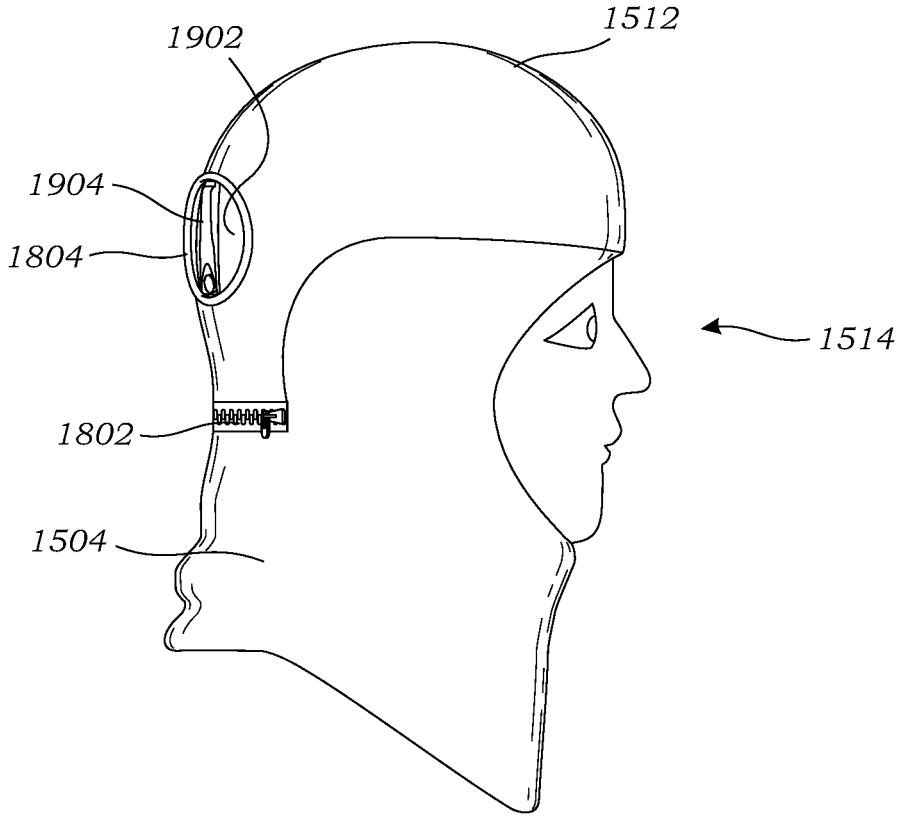
FIG. 19 is a side view of the cover system of FIG. 15 in an unattached face cover configuration.

Referring now to FIG. 19, therein is shown a side view of the cover system 1500 of FIG. 15 in an unattached face cover 1502 of FIG. 15 configuration. The helmet cover 1512 is depicted attached to the neck cover 1504 with the removable attachment 1802. The helmet cover 1512 is depicted covering a helmet 1902 with a back portion 1904 of the helmet 1902 exposed from the opening 1804.

The pack portion of the helmet 1902 can include a stay 1904 for threading goggle straps (not shown) therethrough and thereby securing goggles to the helmet while providing removability of the goggles from the stay 1904 of the helmet 1902 without needing to remove the helmet cover 1512. Instead the goggle strap can be accessed from the helmet cover 1512 and can be manipulated along with the stay 1904.

Figure 20:
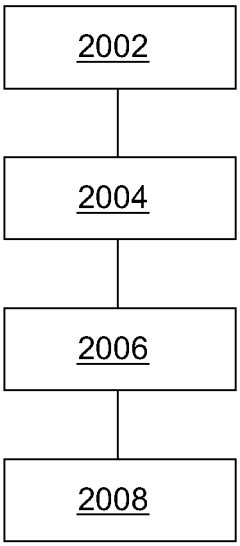
FIG. 20 is a flow chart for manufacturing the cover system.

Referring now to FIG. 20, therein is shown a flow chart for manufacturing the cover system. The method of manufacturing the cover system can include providing a cover, the cover including face cover, neck cover, crown cover, side cover, and back cover in a block 2002; creating a cover opening in the cover above the face cover for exposure of facial features of a user from the cover in a block 2004; attaching a helmet cover at an attachment point near the back cover configured to expand around a helmet in a block 2008; and forming a helmet cover opening in the helmet cover configured to allow access to a back portion of the helmet in a block 2010.

Thus, it has been discovered that the cover system furnishes important and heretofore unknown and unavailable solutions, capabilities, and functional aspects. The resulting configurations are straightforward, cost-effective, uncomplicated, highly versatile, accurate, sensitive, and effective, and can be implemented by adapting known components for ready, efficient, and economical manufacturing, application, and utilization.

While the cover system has been described in conjunction with a specific best mode, it is to be understood that many alternatives, modifications, and variations will be apparent to those skilled in the art in light of the preceding description. Accordingly, it is intended to embrace all such alternatives, modifications, and variations, which fall within the scope of the included claims. All matters set forth herein or shown in the accompanying drawings are to be interpreted in an illustrative and non-limiting sense.

What is claimed is:

1. A cover system comprising:

a cover, the cover including a face cover, neck cover, crown cover, side cover, and a back cover;

a cover opening in the cover above the face cover for exposing facial features of a user from the cover;

a helmet cover attached at an attachment point near the back cover, the neck cover providing coverage for a rear neck area of the user, and the helmet cover providing an extended helmet cover configuration with the helmet cover extended up from an attachment point around a helmet, and providing a retracted helmet cover configuration with the helmet cover extending from the attachment point to contact portions of the neck cover between the neck and the helmet cover; and a helmet cover opening in the helmet cover configured to allow access to a back portion of the helmet.

2. The system of claim 1 further comprising:

a first fastener affixed to a cover opening side; and a second fastener affixed to a face cover side.

3. The system of claim 2 wherein the first fastener and the second fastener are magnets.

4. The system of claim 1 wherein the helmet cover is releasably affixed near the back cover with a zipper.

5. The system of claim 1 wherein the helmet cover opening is formed facing an opposite direction of the cover opening.

6. A cover system comprising:

a cover, the cover including a face cover, neck cover, crown cover, side cover, and a back cover;

a cover opening in the cover above the face cover for exposing facial features of a user from the cover;

a helmet cover attached at an attachment point near the back cover, the neck cover providing coverage for a rear neck area of the user, and the helmet cover providing an extended helmet cover configuration with the helmet cover extended up from an attachment point around a helmet, and providing a retracted helmet cover configuration with the helmet cover extending from the attachment point to contact portions of the neck cover between the neck and the helmet cover;

a helmet cover opening in the helmet cover configured to allow access to a back portion of the helmet; and linings around the cover opening.

7. The system of claim 6 further comprising vent holes within the face cover.

8. The system of claim 6 further comprising an extension affixed to the helmet cover.

9. The system of claim 8 wherein the extension includes:

a visor;

a baseball hat;

an animal feature;

a ball; or a combination thereof.

10. The system of claim 1 wherein the helmet cover is configured to stretch over a helmet and allow straps of the helmet to extend down from the helmet and to be buckled below the face cover.

* * * * *